US005273173A

United States Patent [19]

Debetencourt

[11] Patent Number: 5,273,173

[45] Date of Patent: Dec. 28, 1993

[54] SCREW TOP

[75] Inventor: Jean Debetencourt, Maulde, Belgium

[73] Assignee: Lynes Holding S.A., Luxembourg, Luxembourg

[21] Appl. No.: 13,998

[22] Filed: Feb. 5, 1993

Related U.S. Application Data

[63] Continuation of Ser. No. 592,490, Oct. 4, 1990.

[30] Foreign Application Priority Data

Feb. 5, 1990 [EP] European Pat. Off. ..... 90870020.6

[51] Int. Cl.[5] ..... B65D 41/32

[52] U.S. Cl. ..... 215/252; 215/258

[58] Field of Search ..... 215/252, 253, 256, 258

[56] References Cited

U.S. PATENT DOCUMENTS

| | | | |
|---|---|---|---|
| 3,737,064 | 6/1973 | Patel et al. | 215/252 |
| 4,147,268 | 4/1979 | Patel et al. . | |
| 4,326,639 | 4/1982 | Stahl et al. | 215/252 |
| 4,346,811 | 8/1982 | Hilaire | 215/252 |
| 4,527,706 | 7/1985 | Swartzbaugh et al. . | |
| 4,577,770 | 3/1986 | Wright | 215/252 |
| 4,919,285 | 4/1990 | Roof et al. | 215/252 X |
| 4,978,017 | 7/1991 | McBride | 215/252 |

FOREIGN PATENT DOCUMENTS 2099800 12/1982 United Kingdom .

*Primary Examiner*—Allan N. Shoap
*Assistant Examiner*—Paul A. Schwarz
*Attorney, Agent, or Firm*—Jacobson, Price, Holman & Stern

[57] ABSTRACT

The invention relates to a screw top comprising essentially two elements formed by a skirt and a sealing ring connected together in a number of places by means of small cross-elements which can be broken when unscrewing the top, characterised in that of said two elements, either the skirt (2) or the sealing ring (3) comprises prolongations (8-10) which extend sufficiently far towards and beyond the opposite element so as to prevent any deformation of the sealing ring (3) in the radial direction of the top.

3 Claims, 2 Drawing Sheets

SCREW TOP

This is a continuation of application Ser. No. 07/592,490, filed Oct. 4, 1990.

The present invention relates to a screw top comprising essentially two elements formed by a skirt and a sealing ring which is in a predetermined number of places connected to said skirt by means of small cross-elements which can be broken when unscrewing the top due to their small section.

A top which offers this particularity has been the subject of the Luxemburg Patent Application No. 87469 of Mar. 8, 1989 in the name of the applicant.

The top described in this patent application has such a structure that the displacements of the skirt with respect to the sealing ring according to the geometrical axis of the top do not cause a too early and thus untimely separation of these two top elements. The tops of this type, conceived by the applicant, form thus from this point of view a remarkable amelioration.

However, it appeared that the sealing ring could still come loose from the skirt due to shocks transmitted to these tops during their transfer in distribution machines. Indeed, the lateral shocks transmitted to these tops can cause the rupture of some of the small cross-elements to which is referred to in the preamble.

The present Patent Application has for object to remedy this serious disadvantage which causes that too much tops have to be removed and which requires anyway inspections which have to be avoided.

In order to realise this object according to the invention and in order to allow to manufacture tops which are not subject to damage during their manipulations, the screw top according to the invention is characterised in that either said skirt or said sealing ring of said two elements comprises either internally or externally and at least locally prolongations which extend sufficiently far towards and beyond the opposite element so as to prevent any deformation of said sealing ring in the radial direction of the top, which deformations are a cause of rupture of said small cross-elements.

Other details and advantages of the invention will appear from the following description of a screw top equiped with a sealing ring according to the invention. This description is only given by way of example and does not limit the invention. The reference numerals relate to the annexed figures.

Figure 1:
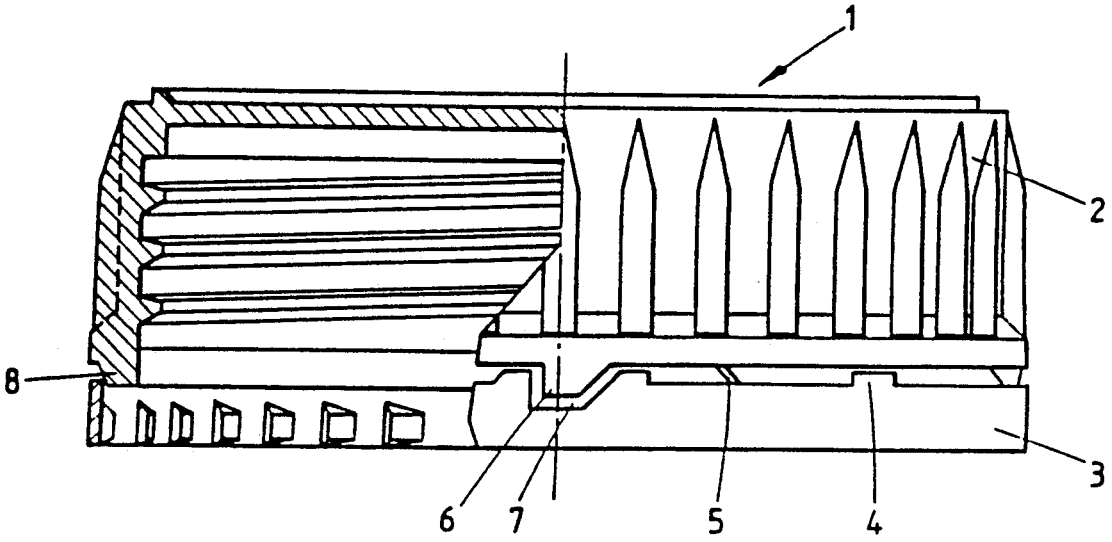
FIG. 1 is partly a section and partly an elevational view of the top according to the invention in a first embodiment.

The screw top 1 shown in these four figures comprises a skirt 2 and a sealing ring 3

On the skirt or on the sealing ring can be provided protective backing elements 4 which prevent that the skirt 2 approaches completely the sealing ring 3 whereby some of the small cross-elements 5 connecting the sealing ring to the skirt would break.

All these details, such as the presence of a tooth 6 projecting into a cutout 7 of the sealing ring 2, have been described in the above mentioned Luxemburg Application.

It is to be noted that the present invention aims at improving these but also other types of tops provided that they comprise a skirt, a sealing ring and small cross-elements connecting these elements together.

In order to avoid that one or more of these small cross-elements would be broken during mechanical manipulations, means are provided, according to the present Patent Application, which prevent any radial displacement of the sealing ring 3, i.e. any movement towards the in—or the outside of the top.

This object can be reached by different possible, technical embodiments but it will be clear that some of them will give problems with respect to the design of the injection moulds.

Referring to FIG. 1, it can be seen that the skirt 2 comprises a prolongation 8 directed towards the sealing ring 3. When the top and the sealing ring take the position shown in the figure, i.e. when the small cross-elements aren't broken yet, the prolongation 8 of the skirt 2 of the top extends sufficiently far so as to prevent any radial deformation of the sealing ring. Thereto it is enough that the prolongation 8 extends a tenth of a millimeter of some tenths of a millimeter beyond the edge of the sealing ring which is directed towards the skirt.

Figure 2:
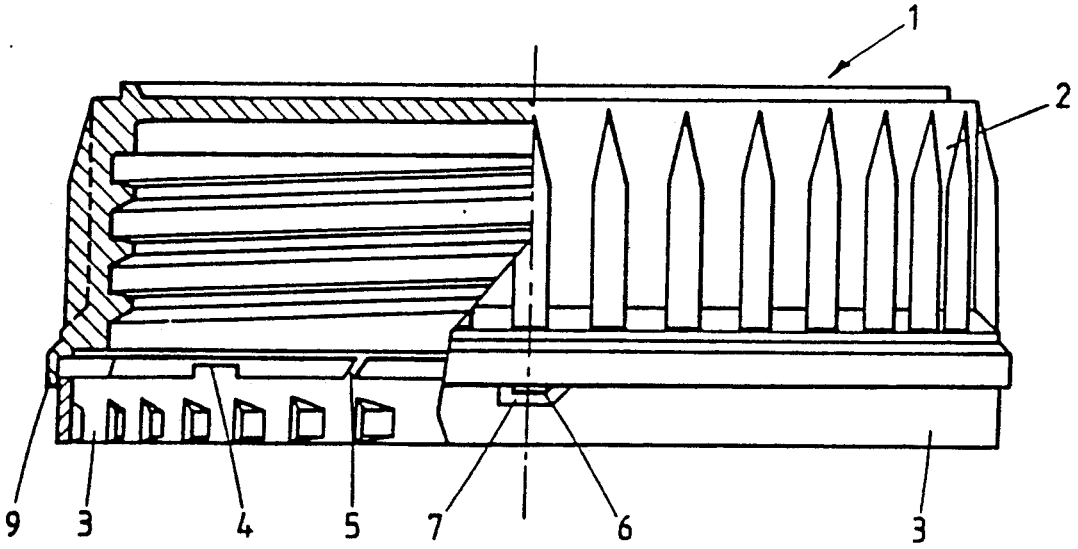
FIG. 2 is an analogeous view related to a first variant.

A first variant of the top according to the invention is represented in FIG. 2 wherein the prolongation, indicated here by reference 9, is provided at the outer side of the sealing ring 3. It's enough that the prolongation 9 extends very slightly beyond the free edge of the sealing ring 3 to prevent any radial movement of this sealing ring. In the two cases, the sealing ring keeps perfectly its circular shape and no rupture of the small cross-elements 5 is to be feared.

Figure 3:
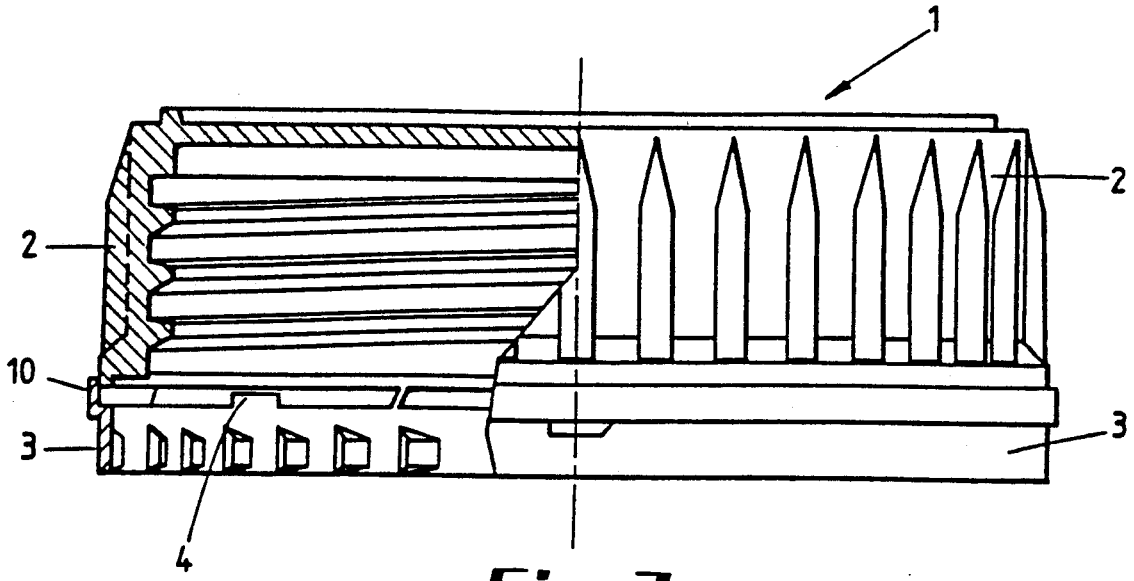
FIG. 3 is an analogeous view related to a second variant.
Figure 4:
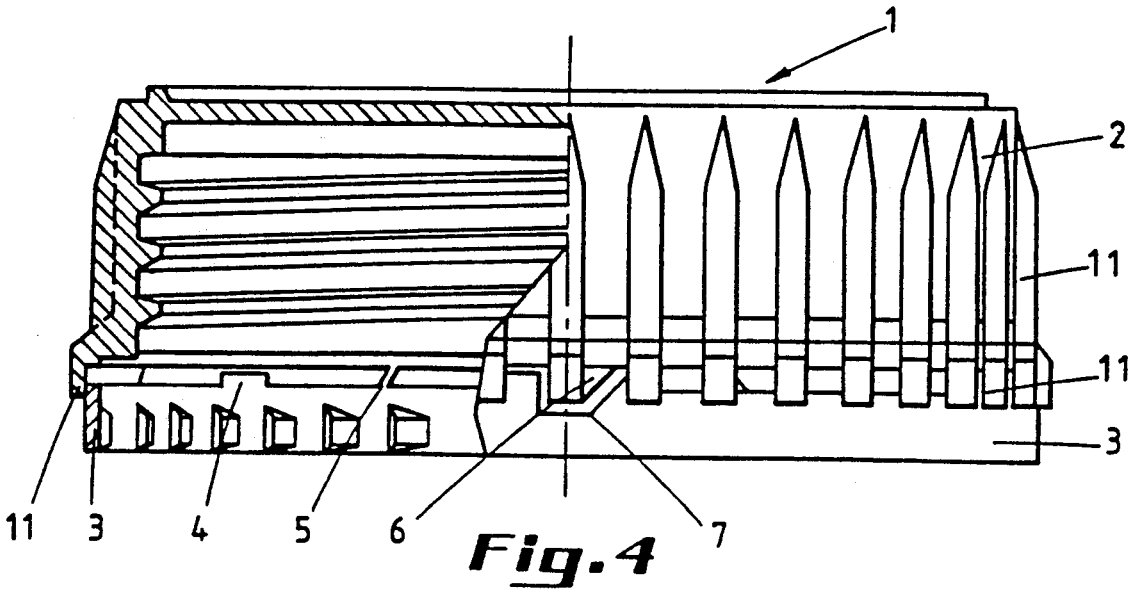
FIG. 4 is an analogeous view related to a third variant.

The same situation is created by the second variant shown in FIG. 3 wherein it is on the contrary the sealing ring 3 which is provided with a prolongation, indicated by reference 10, at the outsider of the part of the top skirt 2 which is directed towards the sealing ring.

It will be clear that even when the most logical embodiments consist in providing prolongations 8–10 extending circularly over the total periphery either of the skirt of the top or of the sealing ring, these prolongations could also be provided at some places only.

In a last variant it would also be possible to prolong all the ribs 11 or some of them. By rib it has to be understood the vertical projections, the skirt of certain tops present at the outside, generally with the object to make screwing and unscrewing easier.

Although several embodiments have been described, some of which have to be considered as preferred embodiments from the point of view of realizing pieces which permit the injection of tops according to the invention, it will be noted that all these embodiments realize the same object which is to prevent any radial movement of the sealing ring, these movements being the cause of the rupture of the small cross-elements 5.

In principle, the invention is thus not limited to the described embodiments and many modifications could be brought thereon without leaving the scope of the present Patent Application.

What is claimed is:

1. A screw top comprising:

a skirt, a sealing ring, a predetermined number of cross-elements extending between a lower edge of said skirt and an upper edge of said sealing ring for being broken when unscrewing the skirt due to their small section, prolongation means extending from said lower edge of said skirt towards and beyond said upper edge of said sealing ring along an innermost side of said sealing ring for preventing any deformation of said sealing ring in a radial direction so as to avoid rupture of said cross-elements.

2. A screw top as claimed in claim 1, wherein said prolongations extend in a direction substantially parallel to a geometrical axis of said top.

3. A screw top as claimed in claim 1, wherein the prolongation means comprises a plurality of circumferentially spaced prolongations.

* * * * *